US011658412B2

(12) United States Patent
Luo et al.

(10) Patent No.: US 11,658,412 B2
(45) Date of Patent: May 23, 2023

(54) ANTENNA AND TERMINAL

(71) Applicant: HUAWEI TECHNOLOGIES CO., LTD., Shenzhen (CN)

(72) Inventors: Xin Luo, Chengdu (CN); Yi Chen, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 66 days.

(21) Appl. No.: 17/209,613

(22) Filed: Mar. 23, 2021

(65) Prior Publication Data

US 2021/0210853 A1 Jul. 8, 2021

Related U.S. Application Data

(63) Continuation of application No. PCT/CN2018/107779, filed on Sep. 26, 2018.

(51) Int. Cl.
*H01Q 3/36* (2006.01)
*H01Q 19/26* (2006.01)
(Continued)

(52) U.S. Cl.
CPC ..... *H01Q 3/36* (2013.01); *H01Q 3/40* (2013.01); *H01Q 9/16* (2013.01); *H01Q 19/24* (2013.01); *H01Q 19/26* (2013.01)

(58) Field of Classification Search
CPC ..... H01Q 3/36; H01Q 3/40; H01Q 9/16; H01Q 19/24; H01Q 19/26; H01Q 3/44
See application file for complete search history.

(56) References Cited

U.S. PATENT DOCUMENTS 6,407,719 B1 * 6/2002 Ohira ..... H01Q 3/44 343/893
6,677,898 B2 * 1/2004 Cheng ..... H01Q 3/24 343/893
(Continued)

FOREIGN PATENT DOCUMENTS

CN 1256819 A 6/2000
CN 1762070 A 4/2006
(Continued)

OTHER PUBLICATIONS

Liu Xueguan, "Microwave Technology and Antenna (4th Edition)", Xi"an University of Electronic Science and Technology Press, 2015, 6 pages (with an English abstract).
(Continued)

*Primary Examiner* — Vibol Tan
(74) *Attorney, Agent, or Firm* — Maier & Maier, PLLC

(57) ABSTRACT

An antenna includes a first element, a second element, and a reactance-adjustable component. The first element receives an excitation current through an electrical connection to an antenna feeder, and the second element generates an induced current through electromagnetic induction of the first element. The reactance-adjustable component is disposed at an end of the first element close to a reference plane, and/or the reactance-adjustable component is disposed at an end of the second element close to a reference plane. The reference plane uses a connection point between the first element and the antenna feeder as an origin point and is perpendicular to an axial direction of the first element. The reactance-adjustable component has an adjustable reactance value and is configured to adjust a phase difference between an excitation current and an induced current, where the phase difference has an association relationship with a target angle of radiation of the antenna.

20 Claims, 9 Drawing Sheets

(51) Int. Cl.

| | |
|---|---|
| ***H01Q 3/40*** | (2006.01) |
| ***H01Q 9/16*** | (2006.01) |
| ***H01Q 19/24*** | (2006.01) |

(56) References Cited

U.S. PATENT DOCUMENTS

| | | | | |
|---|---|---|---|---|
| 7,391,386 | B2 * | 6/2008 | Sawaya | H01Q 1/2275 343/750 |
| 8,405,567 | B2 * | 3/2013 | Park | H01Q 19/32 343/893 |
| 9,130,262 | B2 * | 9/2015 | Park | H01Q 9/0442 |
| 2002/0008672 | A1 | 1/2002 | Gothard et al. | |
| 2004/0032370 | A1 | 2/2004 | Ito et al. | |
| 2016/0190684 | A1 | 6/2016 | Montgomery et al. | |
| 2019/0319354 | A1 | 10/2019 | Zhang et al. | |

FOREIGN PATENT DOCUMENTS

| | | | | |
|---|---|---|---|---|
| CN | 102164000 | A | 8/2011 | |
| CN | 102576937 | A | 7/2012 | |
| CN | 103346392 | A | 10/2013 | |
| CN | 103367875 | A | 10/2013 | |
| CN | 104022339 | A | 9/2014 | |
| CN | 106785449 | A | 5/2017 | |
| CN | 207638010 | U | 7/2018 | |
| EP | 1030401 | A1 | 8/2000 | |
| EP | 1589610 | A1 * | 10/2005 | H01Q 1/2266 |
| JP | 2003304112 | A | 10/2003 | |
| JP | 2004134873 | A | 4/2004 | |
| JP | 2005094367 | A | 4/2005 | |
| JP | 2017200002 | A | 11/2017 | |
| WO | 2013090456 | A1 | 6/2013 | |

OTHER PUBLICATIONS

IEE Computer Society. "IEEE Standard for Information technology—Telecommunications and information exchange between systems Local and metropolitan area networks—Specific requirements, Part 11: Wireless LAN Medium Access Control (MAC) and Physical Layer (PHY) Specifications, Amendment 4: Enhancements for Very High Throughput for Operation in Bands below 6 GHz." IEEE Standards Association. 802.11ac-2013. Dec. 11, 2013. 425 pages.

802.11 Working Group of the LAN/MAN Standards Committee of the IEEE Computer Society. "IEEE P802.11axTM/D2.2, Draft Standard for Information technology—Telecommunications and information exchange between systems Local and metropolitan area networks-Specific requirements. Part 11: Wireless LAN Medium Access Control (MAC) and Physical Layer (PHY) Specifications, Amendment 6: Enhancements for High Efficiency WLAN." IEEE. Feb. 2018. 620 pages.

Sun et al., A novel frequency and pattern reconfigurable parasitic monopole antenna array for wireless communications, 2011, 6 pages with English-language Abstract.

* cited by examiner

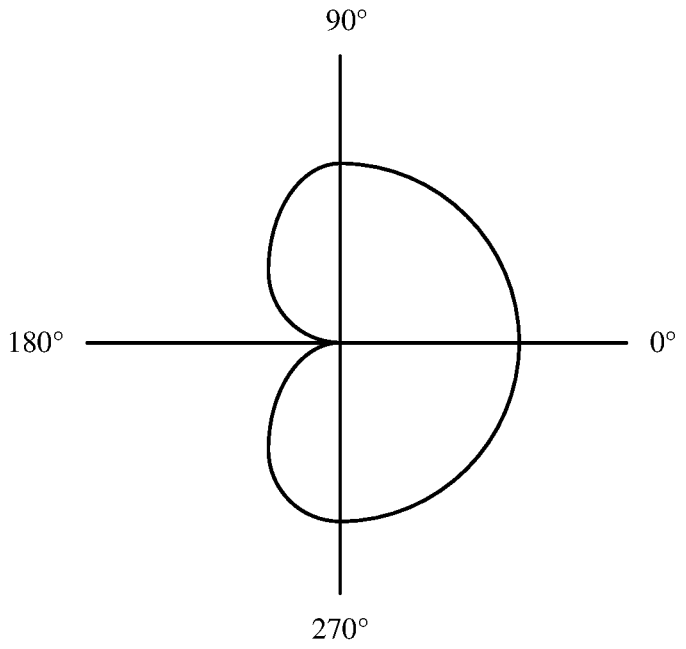
FIG. 3A1
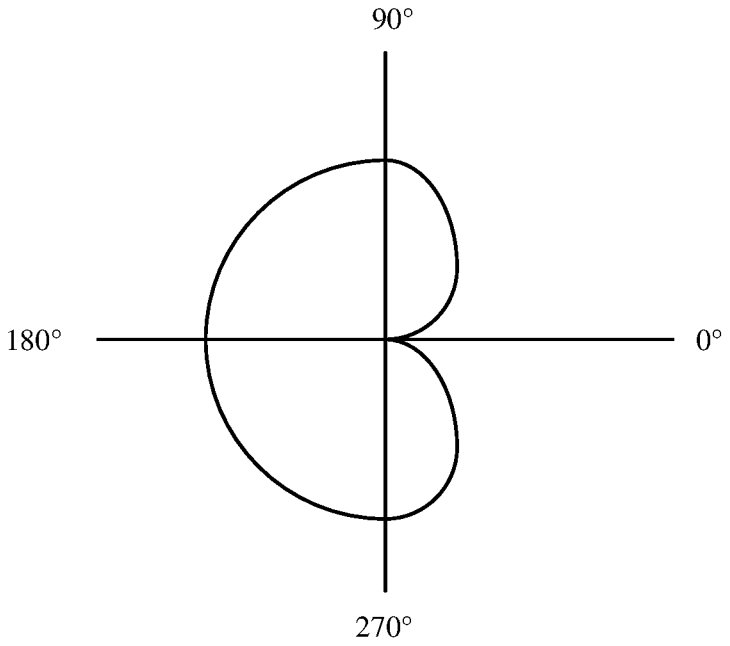
FIG. 3B1

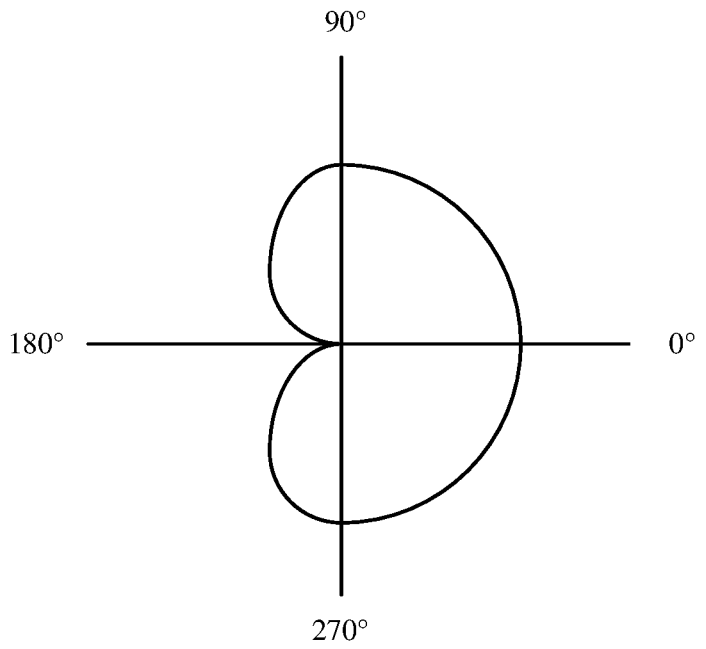
FIG. 3A2
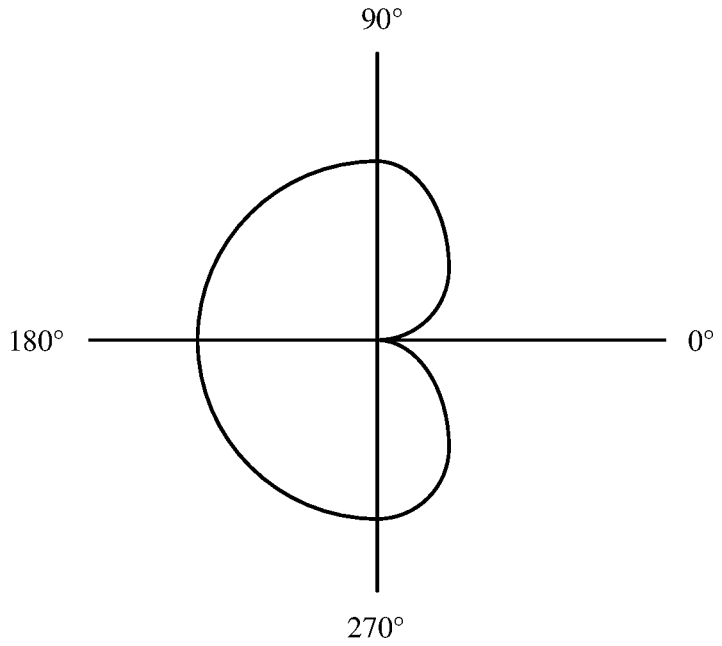
FIG. 3B2

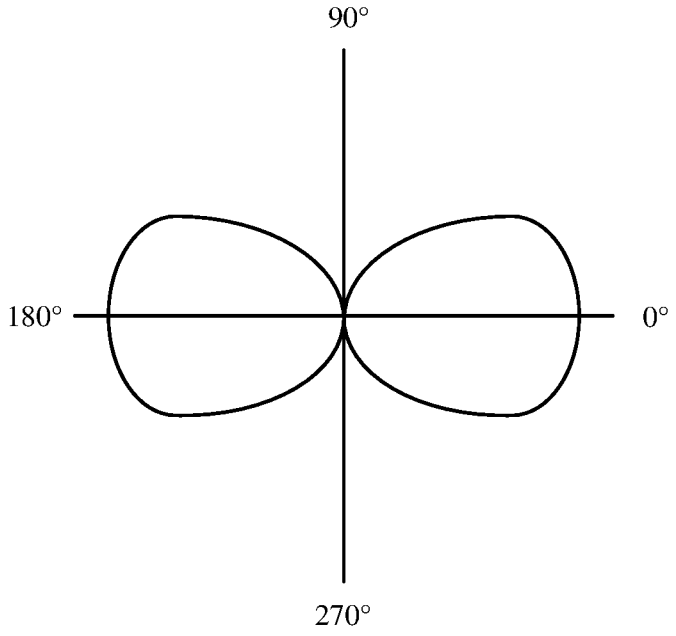
FIG. 3C2
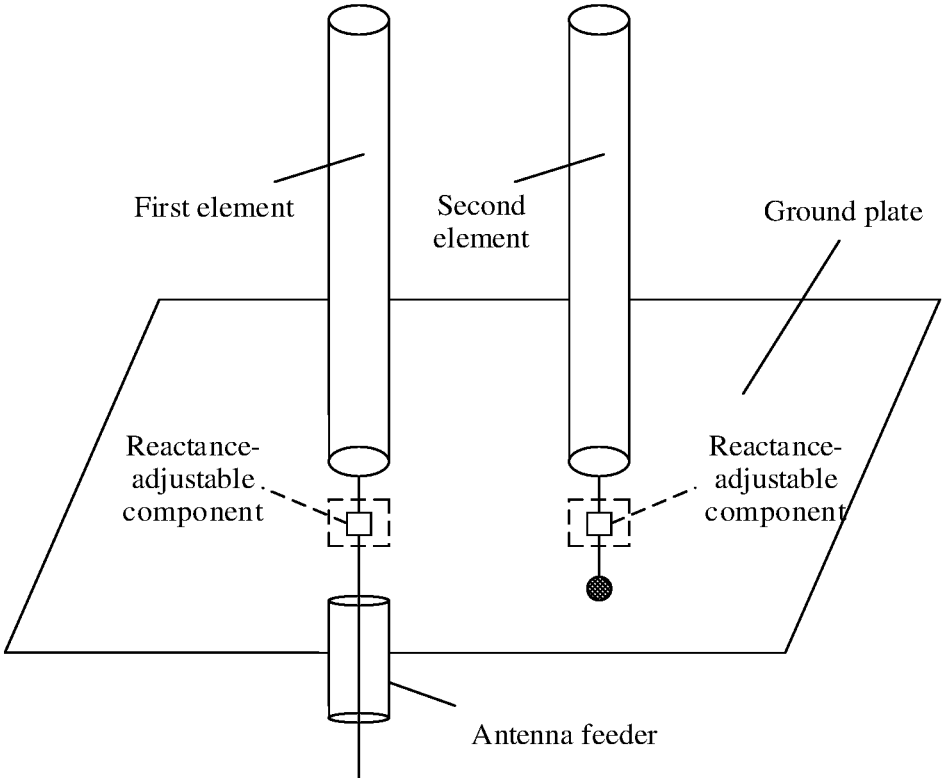
FIG. 4A

ANTENNA AND TERMINAL

CROSS-REFERENCE TO RELATED APPLICATIONS

This application is a continuation of International Application No. PCT/CN2018/107779, filed on Sep. 26, 2018, the disclosure of which is hereby incorporated by reference in its entirety.

TECHNICAL FIELD

The embodiments relate to the field of antenna technologies, and in particular, to an antenna and a terminal.

BACKGROUND

With gradual improvement of antenna technologies, a type of indoor wireless fidelity (Wi-Fi) antenna has started to change and develop from an omnidirectional antenna to a smart antenna. Generally, a smart antenna can concentrate radiated energy in a direction of a user based on a user location, instead of uniformly and changelessly covering all directions as an omnidirectional antenna does.

As shown in FIG. 1A, a smart antenna includes an element connected to an antenna feeder (generally, the element connected to the antenna feeder is referred to as an active element, and an active element is used as an example in FIG. 1A), a passive induction unit disposed around the active element, a control circuit (not shown in FIG. 1A), at least one electronic switch, and a ground plate. The passive induction unit includes at least one element (generally, an element that is not connected to the antenna feeder is referred to as a passive element, and two passive elements are used as an example in FIG. 1A). An electronic switch is disposed between each passive element and the ground plate, and the control circuit can control a connection status between the passive element and the ground plate by controlling an on/off state of the electronic switch.

As shown in FIG. 1B, a smart antenna includes an element connected to an antenna feeder (similar to the foregoing smart antenna, an active element is used as an example in FIG. 1B), a passive induction unit disposed around the active element, a control circuit (not shown in FIG. 1B), and at least one electronic switch. The passive induction unit includes at least one element (similar to the foregoing smart antenna, two passive elements are used as an example in FIG. 1B). An electronic switch is disposed between an upper arm and a lower arm of each passive element. The control circuit can control a change of a resonance length of the passive induction unit by controlling an on-off state of the electronic switch.

Generally, whether the passive induction unit generates an induced current can be controlled by controlling connection or disconnection between the passive induction unit and the ground plate or by adjusting the change of the resonance length of the passive induction unit, to implement directional radiation of the smart antenna. Specifically, when the passive induction unit generates no induced current, a radiation direction pattern of the smart antenna is an omnidirectional mode. When the passive induction unit generates an induced current, the passive induction unit plays a reflection or directing function, so that the radiation direction pattern of the smart antenna changes to a directional mode.

However, actual requirements for directional modes of different directions of the smart antenna can be implemented only when more passive elements are placed in different directions around the active element, which is likely to increase a size of the smart antenna. With the development of the Wi-Fi standard 802.11ac to the Wi-Fi standard 802.11ax, the Wi-Fi standard 802.11ac supports 4×4 multiple-input multiple-output (MIMO), and four antennas need to be placed on a terminal; the Wi-Fi standard 802.11ax supports an 8×8 (MIMO, and therefore, eight antennas need to be placed on a terminal, which is also likely to increase a size of a smart antenna on the terminal.

Therefore, to place more smart antennas in limited space of the terminal, a smart antenna with a small size and a low contour is urgently needed.

SUMMARY

The embodiments provide an antenna and a terminal to implement that a beam radiated by an antenna can be directed to any direction specified by a user, while meeting a requirement for a small size and a low contour, so that more antennas are placed in limited space of a terminal and receiving performance of the terminal meets an actual requirement.

According to a first aspect, the embodiments provide an antenna, including a first element, a second element, and a reactance-adjustable component.

The first element receives an excitation current through an electrical connection to an antenna feeder, and the second element generates an induced current through electromagnetic induction of the first element.

The reactance-adjustable component is disposed at an end of the first element close to a reference plane, and/or the reactance-adjustable component is disposed at an end of the second element close to a reference plane; and the reference plane uses a connection point between the first element and the antenna feeder as an origin point and is perpendicular to an axial direction of the first element.

The reactance-adjustable component has an adjustable reactance value and is configured to adjust a phase difference between the excitation current and the induced current, where the phase difference has an association relationship with a target angle of radiation of the antenna.

According to the antenna provided in the first aspect, the reactance value of the reactance-adjustable component may be changed based on a direction required by a user to adjust the phase difference between the excitation current received by the first element and the induced current generated by the second element, to implement that the target angle of radiation of the antenna points to the direction required by the user. In this way, the antenna including only two elements and the reactance-adjustable component has characteristics of a small size and a low contour, thereby implementing that the beam radiated by the antenna points to any direction specified by the user.

In a possible implementation, the association relationship between the phase difference and the target angle is determined according to Formula 1:

$$F(\varphi)=f_{element}(\varphi)*f_{array}(\varphi) \qquad \text{Formula 1}$$

where $F(\varphi)$ is a direction pattern function of an array formed by the first element and the second element, $f_{element}(\varphi)$ is an element factor function, $f_{array}(\varphi)$ is an array factor function, $f_{array}(\varphi)=\cos((kd\cos\varphi+\zeta)/2)$, $k=2\pi/\lambda$ is a wave vector of an electromagnetic wave, d is a distance between the first element and the second element, $\varphi$ is a target angle, and $\zeta$ is the phase difference between the excitation current and the induced current.

In a possible implementation, the reactance value of the reactance-adjustable component has an association relationship with the phase difference, the association relationship between the reactance value of the reactance-adjustable component and the phase difference is represented by a complex matrix S, and the complex matrix S is determined by using Formula 2:

$$[S] = \frac{1}{2 + jX/R_0}\begin{bmatrix} \frac{jX}{R_0} & 2 \\ 2 & \frac{jX}{R_0} \end{bmatrix} \quad \text{Formula 2}$$

where $jX=j(X_L-X_C)$ is the reactance value of the reactance-adjustable component, $$-X_C = -\frac{1}{\omega C}$$

is a capacitive reactance value of the reactance-adjustable component, $X_L=\omega L$ is an inductance value of the reactance-adjustable component, L is an inductance value of the reactance-adjustable component, C is a capacitance value of the reactance-adjustable component, ω is an angular frequency, and $R_0$ is a characteristic impedance.

In a possible implementation, the phase difference further has an association relationship with a length of the antenna and the distance between the first element and the second element.

According to the antenna provided in the first aspect, both the reactance value of the reactance-adjustable component and the distance between the first element and the second element may be changed based on the direction required by the user, to adjust the phase difference between the excitation current received by the first element and the induced current generated by the second element, to implement that the target angle of radiation of the antenna points to the direction required by the user. In this way, the antenna including only two elements and the reactance-adjustable component has characteristics of a small size and a low contour, thereby implementing that the beam radiated by the antenna points to any direction specified by the user.

In a possible implementation, the distance between the first element and the second element is d, $0.15\lambda \le d \le 0.5\lambda$, and λ is a free space wavelength.

In a possible implementation, both the first element and the second element are monopole antennas; and the reactance-adjustable component is connected in series between the first element and the antenna feeder; and/or the reactance-adjustable component is connected in series between the second element and a ground plate.

In a possible implementation, the first element is a dipole antenna, and the second element is a monopole antenna; and the reactance-adjustable component is connected in series to at least one arm of the first element; and/or the reactance-adjustable component is connected in series between the second element and a ground plate.

In a possible implementation, the phase difference further has an association relationship with a distance between the antenna and the ground plate and a size of the ground plate.

According to the antenna provided in the first aspect, based on a direction required by the user, both the reactance value of the reactance-adjustable component and the distance between the antenna and the ground plate may be changed, or both the reactance value of the reactance-adjustable component and the size of the ground plate may be changed, or the reactance value of the reactance-adjustable component, the distance between the antenna and the ground plate, and the size of the ground plate may be all changed, to adjust the phase difference between the excitation current received by the first element and the induced current generated by the second element, to implement that the target angle of radiation of the antenna points to the direction required by the user. In this way, the antenna including only two elements and the reactance-adjustable component has characteristics of a small size and a low contour, thereby implementing that the beam radiated by the antenna points to any direction specified by the user.

In a possible implementation, both the first element and the second element are dipole antennas; and the reactance-adjustable component is connected in series to at least one arm of the first element, and/or the reactance-adjustable component is connected in series between two arms of the second element.

In a possible implementation, the first element is a monopole antenna, and the second element is a dipole antenna; and the reactance-adjustable component is connected in series between the first element and the antenna feeder; and/or the reactance-adjustable component is connected in series between two arms of the second element.

In a possible implementation, the antenna further includes a control module and an electronic switch, where the electronic switch is connected in series to the second element, and the control module is separately connected to an adjustment end of the reactance-adjustable component and a control end of the electronic switch; and a control module is configured to change the reactance value of the reactance-adjustable component and an on/off state of the electronic switch.

According to the antenna provided in the first aspect, the electronic switch is connected in series to the second element, and the control module turns off the electronic switch so that the second element cannot generate an induced current, thereby implementing omnidirectional radiation of the antenna; and then the control module turns on the electronic switch, and adjusts the reactance value of the reactance-adjustable component according to an actual requirement, thereby implementing radiation at the target angle of the antenna. Further, settings of the control module and the electronic switch can flexibly implement omnidirectional radiation and directional radiation of the antenna, to meet various actual requirements.

In a possible implementation, the reactance-adjustable component includes a capacitor and/or an inductor.

According to a second aspect, an embodiment provides a terminal, including an antenna fixing member and at least one antenna according to the first aspect, where the antenna is disposed on the antenna fixing member.

According to the antenna and terminal provided in the embodiments, the reactance-adjustable component is disposed at an end of the first element close to the reference plane, or the reactance-adjustable component is disposed at an end of the second element close to the reference plane, or reactance-adjustable components are disposed both at an end of the first element close to the reference plane and at an end of the second element close to the reference plane, so that the reactance value of the reactance-adjustable component is changed based on the direction required by the user, to adjust the phase difference between the excitation current received by the first element and the induced current generated by the second element, to implement that the target angle of radiation of the antenna points to the direction required by the user. In the embodiments, the antenna including only two elements and the reactance-adjustable component has characteristics of a small size and a low contour, thereby implementing that the beam radiated by the antenna points to any direction specified by the user. In addition, more antennas can be placed in limited space of the terminal, so that transmitting performance of the terminal can meet an actual requirement.

BRIEF DESCRIPTION OF DRAWINGS

FIG. 3A1 is a schematic diagram of a direction of a beam radiated by an antenna according to an embodiment;

FIG. 3B1 is a schematic diagram of a direction of a beam radiated by an antenna according to an embodiment;

FIG. 3A2 is a schematic diagram of a direction of a beam radiated by an antenna according to an embodiment;

FIG. 3B2 is a schematic diagram of a direction of a beam radiated by an antenna according to an embodiment;

FIG. 3C2 is a schematic diagram of a direction of a beam radiated by an antenna according to an embodiment;

FIG. 4A is a schematic structural diagram of an antenna according to an embodiment;

DETAILED DESCRIPTION OF THE EMBODIMENTS

Embodiments provide an antenna and a terminal, to implement that a beam radiated by an antenna points to any direction specified by a user, while meeting characteristics of a small size and a low contour of the antenna. The antenna has characteristics of low cost and space saving and may be applied to a full-duplex communications system, or may be used as a multiple input multiple output (MIMO) antenna, or may be applied to any other possible application scenario.

To meet requirements of a small size and a low contour of an antenna, embodiments provide an antenna and a terminal. A reactance-adjustable component is disposed at an end of an active element close to a reference plane, or a reactance-adjustable component is disposed at an end of a passive element close to a reference plane, or reactance-adjustable components are disposed both at an end of an active element close to a reference plane and at an end of a passive element close to a reference plane, and further a phase difference between an excitation current received by the active element and an induced current generated by the passive element may be adjusted by changing a reactance value of the reactance-adjustable component, to implement that a target angle of radiation of the antenna points to a direction required by a user. In this way, the antenna including the active element, the passive element, and the reactance-adjustable component not only has characteristics of a small size and a low contour, but also implements that a beam radiated by the antenna points to any direction specified by the user. In addition, more antennas can be placed in limited space of the terminal, so that transmitting performance of the terminal can meet an actual requirement.

The terminal includes but is not limited to a router, an optical network terminal (ONT), and a wireless access point (AP).

The following describes solutions of the antenna in the embodiments with reference to the accompanying drawings of the embodiments by using an example in which the first element is an active element and the second element is a passive element.

Figure 2:
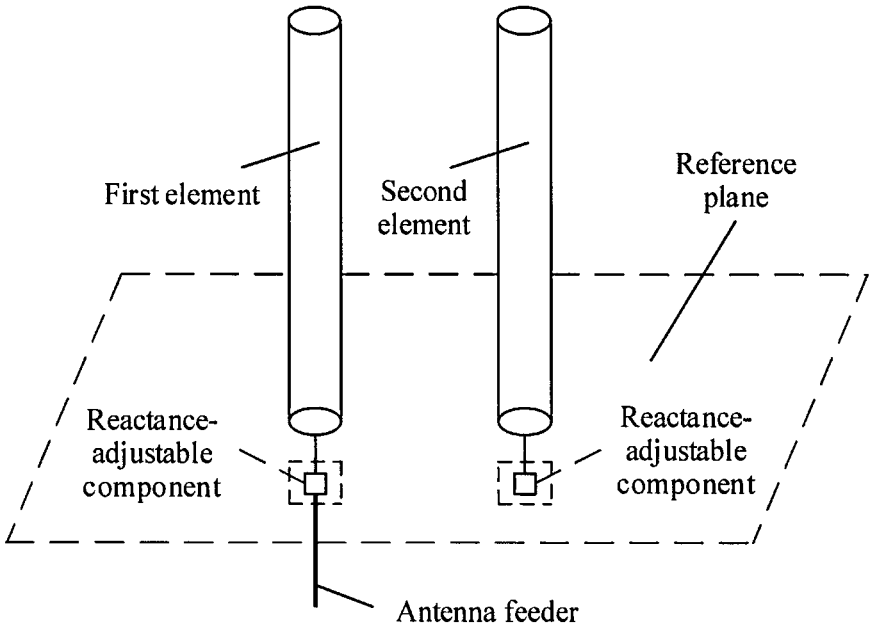
FIG. 2 is a schematic structural diagram of an antenna according to an embodiment.

FIG. 2 is a schematic structural diagram of an antenna according to an embodiment. As shown in FIG. 2, the antenna includes a first element, a second element, and a reactance-adjustable component.

The first element receives an excitation current through an electrical connection to an antenna feeder, and the second element generates an induced current through electromagnetic induction of the first element.

The reactance-adjustable component is disposed at an end of the first element close to a reference plane, and/or the reactance-adjustable component is disposed at an end of the second element close to a reference plane; and the reference plane uses a connection point between the first element and the antenna feeder as an origin point and is perpendicular to an axial direction of the first element.

The reactance-adjustable component has an adjustable reactance value and is configured to adjust a phase difference between the excitation current and the induced current, where the phase difference has an association relationship with a target angle of radiation of the antenna.

It should be noted that the reference plane is a virtual plane and may be any shape, any size, or at any position. This is not limited in this embodiment, provided that the origin of the reference plane is the connection point between the first element and the antenna feeder and is perpendicular to the axial direction of the first element. In addition, relative positions of the first element and the second element are not limited in this embodiment, provided that the first element and the second element are parallel to each other.

For ease of description, an implementation form of the antenna in this embodiment is illustrated by using an example in which, as in FIG. 2, the antenna feeder is connected to a lower end of the first element, the reference plane is a horizontal plane perpendicular to the axial direction of the first element and located below the first element, the origin of the reference plane is the connection point between the antenna feeder and the first element, and the first element and the second element are disposed to be aligned with each other.

In this embodiment, the first element may receive the excitation current on the antenna feeder through an electrical connection to the antenna feeder. As the excitation current changes, a magnetic field around the first element changes, so that the second element may generate the induced current under electromagnetic induction of the first element.

A person of ordinary skill in the art may understand that the first element and the second element may form an antenna array, which is a binary array, and the first element and the second element are array elements in the binary array. According to an antenna array theory, in a plane, the association relationship between the phase difference between the excitation current and the induced current and the target angle may be determined by using Formula 1.

$$F(\varphi)=f_{element}(\varphi)*f_{array}(\varphi) \quad \text{Formula 1}$$

$F(\varphi)$ is a direction pattern function of the binary array, $f_{element}(\varphi)$ is an element factor function, $f_{array}(\varphi)$ is an array factor function, $f_{array}(\varphi)=\cos((kd\cos\varphi+\zeta)/2)$, $k=2\pi/\lambda$ is a wave vector of an electromagnetic wave, d is a distance between the first element and the second element, $\varphi$ is a target angle, and $\zeta$ is the phase difference between the excitation current and the induced current.

In Formula 1, the direction pattern function $F(\varphi)$ of the binary array includes two parts: one part is a direction pattern function of the antenna, namely, an element factor function $f_{element}(\Phi)$, and the other part is the array factor function $f_{array}(\Phi)$. Generally, a direction pattern of the antenna includes a plane E and a plane H. Generally, the plane E is a tangent plane of a direction pattern parallel to an electric field direction, and the plane H is a tangent plane of a direction pattern parallel to a magnetic field direction. Because a plane H of the monopole antenna and a plane H of the dipole antenna are omnidirectional, and the array factor function $f_{array}(\varphi)$ is approximate to 1, the direction pattern function $F(\varphi)$ of the binary array is mainly determined by the array factor function $f_{array}(\varphi)$, that is, $F(\varphi)\propto f_{array}(\varphi)$, and $f_{array}(\varphi)=\cos((kd\cos\varphi+\zeta)/2)$.

When $d=\lambda/4$, the following illustrates, with reference to FIG. 3A1 to FIG. 3B1 by adjusting a value range of the phase difference $\zeta$, a direction of the beam radiated by the antenna.

When $\zeta=\pi/2$, the matrix factor function changes to $f_{array}(\varphi)=\cos(\pi(\cos\varphi-1)/4)$. Specifically, if $\varphi=0°$, electromagnetic waves radiated by the two array elements to a far field are in phase and are added up, and strength is the highest. If $\varphi=180°$, electromagnetic waves radiated by the two array elements to a far field are in reverse phase, one electromagnetic wave is subtracted from the other electromagnetic wave and strength is the smallest. Therefore, the beam radiated by the antenna points to a direction of $\varphi=0°$ along an axis, as shown in FIG. 3A1.

When $\zeta=\pi/2$, the matrix factor function changes to $f_{array}(\varphi)=\cos(\pi(\cos(-\varphi)-1)/4)$. For example, if $\varphi=0°$, electromagnetic waves radiated by the two array elements to a far field are in reverse phase, one electromagnetic wave is subtracted from the other electromagnetic wave and strength is the smallest. If $\varphi=180°$, electromagnetic waves radiated by the two array elements to a far field are in phase and are added up, and strength is the highest. Therefore, the beam radiated by the antenna points to a direction of $\varphi=180°$ along an axis, as shown in FIG. 3B1.

In addition, the following illustrates, with reference to FIG. 3A2 to FIG. 3C2 by adjusting a value range of the phase difference $\zeta$, a direction of the beam radiated by the antenna. A difference from FIG. 3A1 to FIG. 3B1 lies in that the phase difference $\zeta$ has no association relationship with the distance d, that is, $d=\lambda/4$ does not need to be set.

When $\zeta>\pi$ or $\zeta<-\pi$, that is, $\zeta=\pi+\text{deta}$ or $\zeta=\pi-\text{deta}$, where deta>0, the array factor function changes to $f_{array}(\varphi)=\sin(\pi\cos\varphi/4-\text{deta}/2)$ or $f_{array}(\varphi)=\sin(\pi\cos\varphi/4+\text{deta}/2)$, and the direction of the beam radiated by the antenna is shown in FIG. 3A2.

When $\zeta=\pi$ or $\zeta=-\pi$, the array factor function changes to $f_{array}(\varphi)=\sin(\pi\cos\varphi/4)$ or $f_{array}(\varphi)=\sin(\pi\cos\varphi/4)$, and the direction of the beam radiated by the antenna is shown in FIG. 3B2.

When $\zeta<\pi$ or $\zeta>\pi$, that is, $\zeta=\pi-\text{deta}$ or $\zeta=-\pi+\text{deta}$, where deta>0, the array factor function changes to $f_{array}(\varphi)=\sin(\pi\cos\varphi/4+\text{deta}/2)$ or $f_{array}(\varphi)=\sin(\pi\cos\varphi/4-\text{deta}/2)$, and the direction of the beam radiated by the antenna is shown in FIG. 3C2.

Further, the direction pattern function $F(\varphi)$ of the binary array may indicate the direction of the beam radiated by the antenna, and when the phase difference $\zeta$ changes, the direction pattern function $F(\varphi)$ of the binary array also changes accordingly. Therefore, when the phase difference $\zeta$ changes, the direction of the beam radiated by the antenna changes.

A person of ordinary skill in the art may understand that, after any current passes through the reactance-adjustable component, an amplitude and a phase of the current may be determined by using a complex matrix S in Formula 2.

$$[S]=\frac{1}{2+jX/R_0}\begin{bmatrix}\frac{jX}{R_0} & 2\\ 2 & \frac{jX}{R_0}\end{bmatrix} \quad \text{Formula 2}$$

$jX=j(X_L-X_C)$ is the reactance value of the reactance-adjustable component, $$-X_C=-\frac{1}{\omega C}$$

is a capacitive reactance value of the reactance-adjustable component, $X_L=\omega L$ is an inductive reactance value of the reactance-adjustable component, L is an inductance value of the reactance-adjustable component, C is a capacitance value of the reactance-adjustable component, $\omega$ is an angular frequency, and $R_0$ is a characteristic impedance.

Generally, an amplitude of the complex matrix S may be used to calculate an amplitude change before and after the current passes through the reactance-adjustable component, and a phase of the complex matrix S may be used to calculate a phase change before and after the current passes through the reactance-adjustable component. Therefore, in this embodiment, the reactance-adjustable component may be disposed, through welding or conducting wire connection, at an end of the first element close to the reference plane and/or at an end of the second element close to the reference plane. A connection manner is not limited in this embodiment.

In one aspect, the reactance-adjustable component may be disposed at an end of the first element close to the reference plane. When the reactance value of the reactance-adjustable component changes, a phase of the excitation current changes accordingly, so that the phase difference between the excitation current and the induced current can be adjusted.

In another aspect, the reactance-adjustable component may alternatively be disposed at an end of the second element close to the reference plane. In this case, when the reactance value of the reactance-adjustable component changes, a phase of the induced current changes accordingly, so that the phase difference between the excitation current and the induced current can be adjusted.

In still another aspect, reactance-adjustable components may alternatively be disposed both at an end of the first element close to the reference plane and at an end of the second element close to the reference plane. In this case, when the reactance value of the reactance-adjustable component changes, and both a phase of the excitation current and a phase of the induced current change accordingly, so that the phase difference between the excitation current and the induced current can be adjusted.

Further, according to the complex matrix S in Formula 2, it may be determined that the reactance value of the reactance-adjustable component has an association relationship with the phase difference. In addition, according to Formula 1, it may be determined that the phase difference has an association relationship with the target angle of radiation of the antenna. Therefore, the direction of the beam radiated by the antenna may be changed by changing the reactance value of the reactance-adjustable component. Further, in this embodiment, the reactance value of the reactance-adjustable component may be adjusted based on the direction required by the user, so that the target angle of radiation of the antenna faces the direction required by the user. Therefore, the antenna including only two elements and the reactance-adjustable component not only has a small size and a low contour, but also implements that the direction of the beam radiated by the antenna can meet any direction specified by the user.

According to the antenna provided in this embodiment, the reactance-adjustable component is disposed at an end of the first element close to the reference plane, or the reactance-adjustable component is disposed at an end of the second element close to the reference plane, or reactance-adjustable components are disposed both at an end of the first element close to the reference plane and at an end of the second element close to the reference plane, so that the reactance value of the reactance-adjustable component is changed based on the direction required by the user, to adjust the phase difference between the excitation current received by the first element and the induced current generated by the second element, to implement that the target angle of radiation of the antenna points to the direction required by the user. In this embodiment, the antenna including only two elements and the reactance-adjustable component has a small size and a low contour and implements that the beam radiated by the antenna points to any direction specified by the user. In addition, more antennas can be placed in limited space of the terminal, so that transmitting performance of the terminal can meet an actual requirement.

In this embodiment, because the induced current is generated only when an electromagnetic wave generated by the first element is propagated to the second element, there is a natural phase difference $\zeta 1$ between the phase of the induced current and the phase of the excitation current on the first element, and the phase difference $\zeta 1$ is related to the distance d between the first element and the second element. In addition, according to Formula 1, it may be determined that the phase difference has an association relationship with a length of the antenna and the distance d between the first element and the second element.

Therefore, in this embodiment, the phase difference $\zeta$ between the excitation current and the induced current may be adjusted by changing both the reactance value of the reactance-adjustable component and the distance d between the first element and the second element. $\zeta=\zeta 1+\zeta 2$, where $\zeta 1$ is a phase difference caused by a change of the distance d, and $\zeta 2$ is a phase difference caused by a change of the reactance value of the reactance-adjustable component. Therefore, when the phase difference $\zeta$ changes, the target angle of radiation of the antenna may be the direction required by the user, so that the beam radiated by the antenna points to any direction specified by the user.

Further, when the electromagnetic wave generated by the first element is propagated to the second element, if the second element is open-circuited from a ground, a size of the second element does not meet a half-wavelength resonance condition. In this case, no induced current is generated on the second element. If the second element is short-circuited to a ground, according to the mirror image principle, a size of the second element meets a half-wavelength resonance condition, and the second element generates an induced current. Therefore, in this embodiment, a value of the distance d between the first element and the second element may be set. Generally, $0.15\lambda \leq d \leq 0.5\lambda$, where $\lambda$ is a free space wavelength.

In this embodiment, the first element and the second element in the antenna may be of a plurality of types, for example, a monopole antenna and a dipole antenna.

Figure 1A:
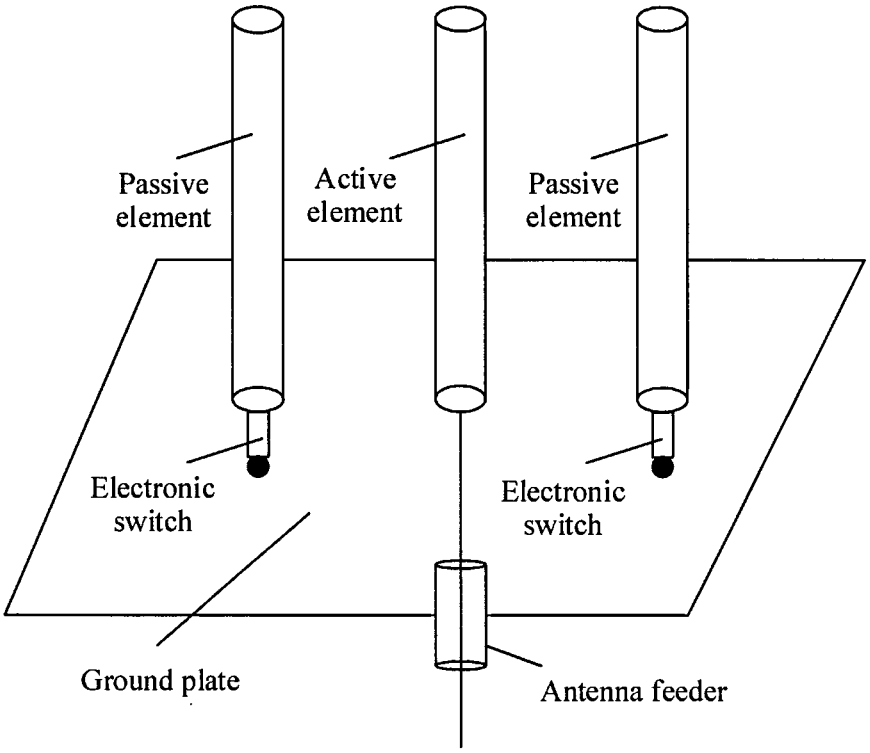
Prior Art FIG. 1A
FIG. 1A is a schematic structural diagram of an antenna.
Figure 1B:
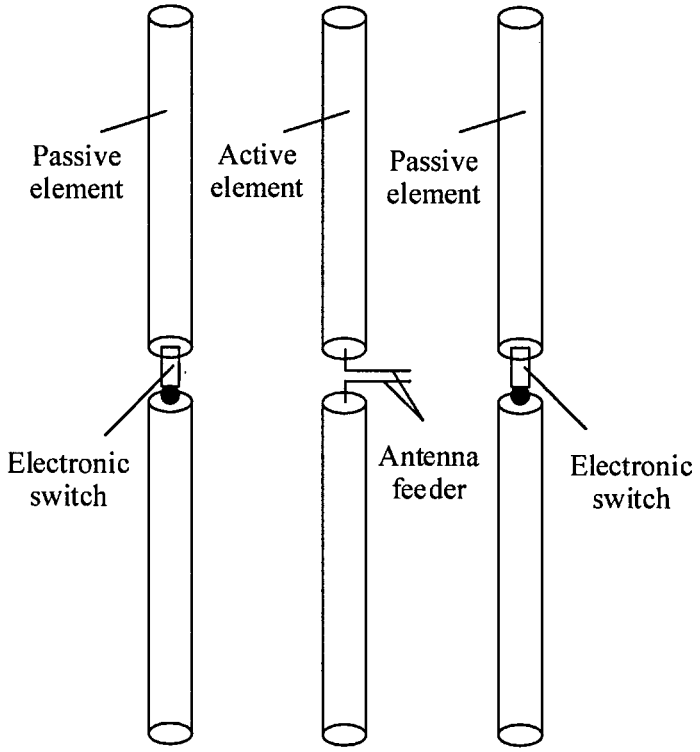
Prior Art FIG. 1B
FIG. 1B is a schematic structural diagram of another antenna.

A person of ordinary skill in the art may understand that the monopole antenna is a vertical antenna having a quarter wavelength, and the antenna is mounted on a ground plate. The ground plate may be a metal plate or may be a copper sheet on a PCB board. This is not limited in this embodiment. The monopole antenna is fed through the antenna feeder (coaxial cable). Therefore, as shown in FIG. 1A, the active element is connected to the antenna feeder, and the passive element is connected to the ground plate. In addition, the dipole antenna is formed by two coaxial straight wires, and the dipole antenna has two arms of equal lengths: an upper arm and a lower arm. The dipole antenna is fed through the antenna feeder (namely, a coaxial cable). Therefore, as shown in FIG. 1B, both an upper arm and a lower arm of the active element are connected to the antenna feeder, and two arms of the passive element are connected to each other.

The following describes, in detail with reference to FIG. 4A to FIG. 4D, specific types of the first element and the second element by using four implementations.

In an implementation, both the first element and the second element are monopole antennas. The reactance-adjustable component is connected in series between the first element and the antenna feeder, and/or the reactance-adjustable component is connected in series between the second element and the ground plate.

As shown in FIG. 4A, when both the first element and the second element are monopole antennas, the reactance-adjustable component may be connected in series between the first element and the antenna feeder, or the reactance-adjustable component may be connected in series between the second element and the ground plate, or reactance-adjustable components may be connected in series both between the first element and the antenna feeder and between the second element and the ground plate.

If the reactance-adjustable component is connected in series only between the first element and the antenna feeder, the phase of the excitation current may be adjusted by changing the reactance value of the reactance-adjustable component, so that the phase difference between the excitation current and the induced current changes accordingly, thereby changing the target angle of radiation of the antenna.

If the reactance-adjustable component is connected in series only between the second element and the ground plate, the phase of the induced current may be adjusted by changing the reactance value of the reactance-adjustable component, so that the phase difference between the excitation current and the induced current changes accordingly, thereby changing the target angle of radiation of the antenna.

If reactance-adjustable components are connected in series both between the first element and the antenna feeder and between the second element and the ground plate, the phase of the excitation current and the phase of the induced current may be adjusted by changing reactance values of the reactance-adjustable components, so that the phase difference between the excitation current and the induced current changes accordingly, thereby changing the target angle of radiation of the antenna.

In another implementation, the first element is a dipole antenna, and the second element is a monopole antenna. The reactance-adjustable component is connected in series to at least one arm of the first element, and/or the reactance-adjustable component is connected in series between the second element and the ground plate.

Figure 4B:
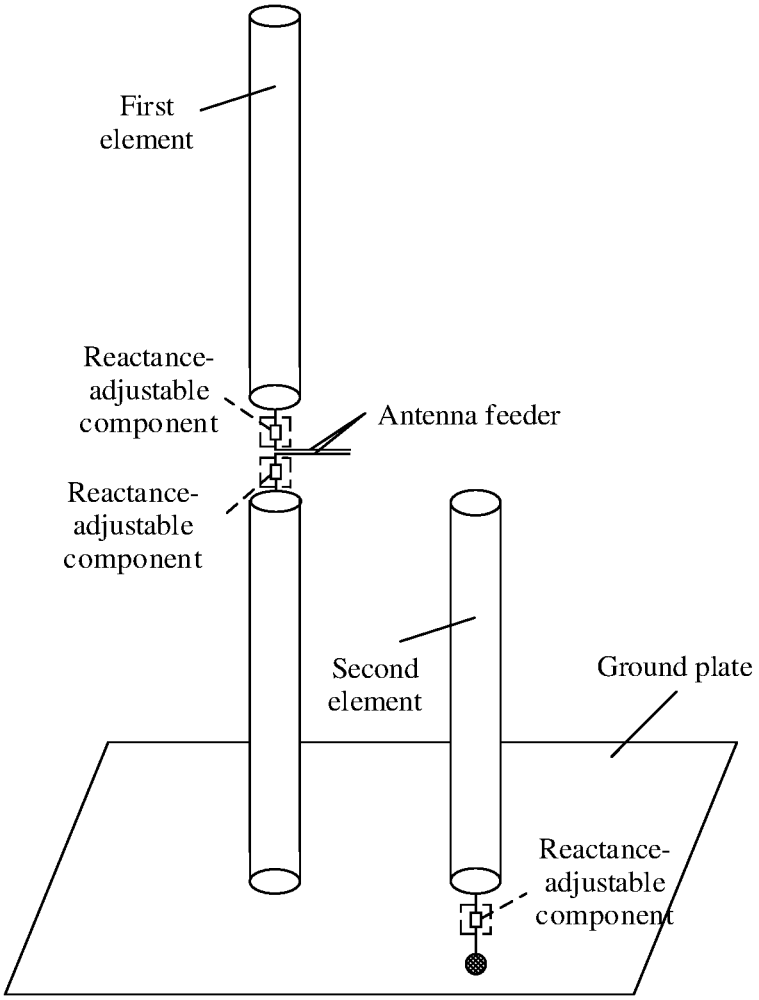
FIG. 4B is a schematic structural diagram of an antenna according to an embodiment.

As shown in FIG. 4B, when the first element is a dipole antenna, and the second element is a monopole antenna, the reactance-adjustable component may be connected in series at an end of an upper arm of the first element close to the reference plane, or the reactance-adjustable component may be connected in series at an end of a lower arm of the first element close to the reference plane, or reactance-adjustable components may be connected in series at ends of two arms of the first element close to the reference plane, or the reactance-adjustable components may be connected in series between the second element and the ground plate, or reactance-adjustable components may be connected in series both on at least one arm of the first element and between the second element and the ground plate.

If the reactance-adjustable component is connected in series only to at least one arm of the first element, the phase of the excitation current may be adjusted by changing the reactance value of the reactance-adjustable component, so that the phase difference between the excitation current and the induced current changes accordingly, thereby changing the target angle of radiation of the antenna.

If the reactance-adjustable component is connected in series only between the second element and the ground plate, the phase of the induced current may be adjusted by changing the reactance value of the reactance-adjustable component, so that the phase difference between the excitation current and the induced current changes accordingly, thereby changing the target angle of radiation of the antenna.

If reactance-adjustable components are connected in series both on at least one arm of the first element and between the second element and the ground plate, the phase of the excitation current and the phase of the induced current may be adjusted by changing reactance values of the reactance-adjustable components, so that the phase difference between the excitation current and the induced current changes accordingly, thereby changing the target angle of radiation of the antenna.

In the foregoing two implementations, the antenna includes the ground plate, and both a location and a size of the ground plate affect the phase difference between the excitation current and the induced current. That is, the phase difference further has an association relationship with a distance between the antenna and the ground plate and with the size of the ground plate. Therefore, in this embodiment, the phase difference between the excitation current and the induced current may be adjusted by changing all of the reactance value of the reactance-adjustable component, the distance between the antenna and the ground plate, and the size of the ground plate, or changing both the reactance value of the reactance-adjustable component and the size of the ground plate without changing the distance between the antenna and the ground plate, or changing both the reactance value of the reactance-adjustable component and the distance between the antenna and the ground plate without changing the size of the ground plate.

In still another implementation, both the first element and the second element are dipole antennas. The reactance-adjustable component is connected in series to at least one arm of the first element, and/or the reactance-adjustable component is connected in series between two arms of the second element.

Figure 4C:
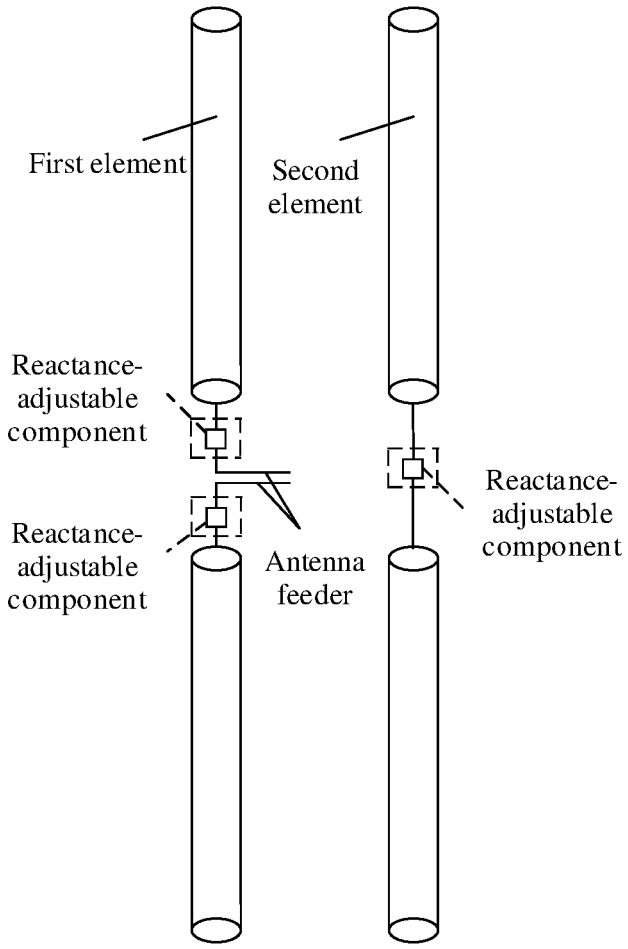
FIG. 4C is a schematic structural diagram of an antenna according to an embodiment.

As shown in FIG. 4C, when both the first element and the second element are dipole antennas, the reactance-adjustable component may be connected in series at an end of an upper arm of the first element close to the reference plane, or the reactance-adjustable component may be connected in series at an end of a lower arm of the first element close to the reference plane, or reactance-adjustable components may be connected in series at ends of two arms of the first element close to the reference plane, or the reactance-adjustable component may be connected in series between two arms of the second element, or reactance-adjustable components may be connected in series both on at least one arm of the first element and between two arms of the second element.

If the reactance-adjustable component is connected in series only to at least one arm of the first element, the phase of the excitation current may be adjusted by changing the reactance value of the reactance-adjustable component, so that the phase difference between the excitation current and the induced current changes accordingly, thereby changing the target angle of radiation of the antenna.

If the reactance-adjustable component is connected in series only between two arms of the second element, the phase of the induced current may be adjusted by changing the reactance value of the reactance-adjustable component, so that the phase difference between the excitation current and the induced current changes accordingly, thereby changing the target angle of radiation of the antenna.

If reactance-adjustable components are connected in series both on at least one arm of the first element and between two arms of the second element, the phase of the excitation current and the phase of the induced current may be adjusted by changing reactance values of the reactance-adjustable components, so that the phase difference between the excitation current and the induced current changes accordingly, thereby changing the target angle of radiation of the antenna.

In still another implementation, the first element is a monopole antenna, and the second element is a dipole antenna. The reactance-adjustable component is connected in series between the first element and the antenna feeder, and/or the reactance-adjustable component is connected in series between two arms of the second element.

Figure 4D:
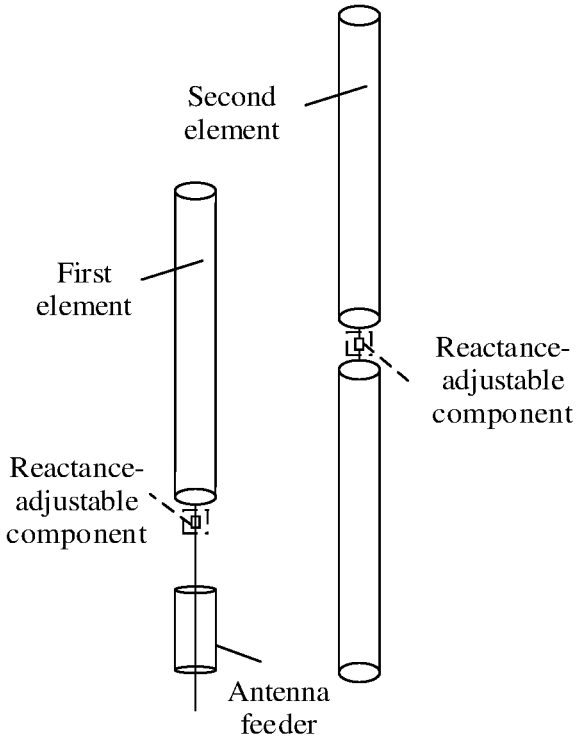
FIG. 4D is a schematic structural diagram of an antenna according to an embodiment.

As shown in FIG. 4D, when the first element is a monopole antenna and the second element is a dipole antenna, the reactance-adjustable component may be connected in series between the first element and the antenna feeder, or the reactance-adjustable component may be connected in series between two arms of the second element, or reactance-adjustable components may be connected in series both between the first element and the antenna feeder and between two arms of the second element.

If the reactance-adjustable component is connected in series only between the first element and the antenna feeder, the phase of the excitation current may be adjusted by changing the reactance value of the reactance-adjustable component, so that the phase difference between the excitation current and the induced current changes accordingly, thereby changing the target angle of radiation of the antenna.

If the reactance-adjustable component is connected in series only between two arms of the second element, the phase of the induced current may be adjusted by changing the reactance value of the reactance-adjustable component, so that the phase difference between the excitation current and the induced current changes accordingly, thereby changing the target angle of radiation of the antenna.

If reactance-adjustable components are connected in series both between the first element and the antenna feeder and between two arms of the second element, the phase of the excitation current and the phase of the induced current may be adjusted by changing reactance values of the reactance-adjustable components, so that the phase difference between the excitation current and the induced current changes accordingly, thereby changing the target angle of radiation of the antenna.

In this embodiment, because the capacitance value changes, the capacitance value changes accordingly, and because the inductance value changes, the inductive reactance changes accordingly. In addition, it is obtained, according to Formula 2, that both the capacitance and the inductance can change the phase of the current, that is, different capacitance values cause different phase shifts of the current, and different inductance values cause different phase shifts of the current, so that the phase difference between the excitation current and the induced current changes. Therefore, the reactance-adjustable component may include a capacitor and/or an inductor.

For example, the reactance-adjustable component may be any series or parallel form of at least one capacitor and/or at least one inductor, and may include: a series form of one adjustable capacitor, a plurality of capacitors connected in series, a plurality of capacitors connected in parallel, one adjustable inductor, a plurality of inductors connected in series, and a plurality of inductors connected in parallel; a parallel form of at least one capacitor and at least one inductor; and the like. Types and quantities of capacitors and inductors are not limited.

In an embodiment, the distance d between the first element and the second element in the antenna keeps unchanged, that is, $d=\lambda/4$, and an adjustable capacitor is disposed only at an end of the second element close to the reference plane. Therefore, a natural phase difference $\zeta 1$ between the induced current and the excitation current keeps unchanged, a capacitance value of the adjustable capacitor changes, and the phase difference $\zeta 2$ of the induced current changes accordingly, so that the phase difference $\zeta=\zeta 1+\zeta 2$ between the excitation current and the induced current changes, thereby adjusting the direction of the beam radiated by the antenna.

For example, when $\zeta 1=-\pi/2$, if the capacitance value C is equal to infinity so that $\zeta 2=0$. In this case, $\zeta=-\pi/2$, and the beam points to a direction of $\varphi=0°$ along the axis, as shown in FIG. 3A1. If the capacitance value C makes $\zeta 2=\pi$, $\zeta=\pi/2$, and the beam points to a direction of $\varphi=180°$ along the axis, as shown in FIG. 3B1.

In another embodiment, the phase difference $\zeta$ between the excitation current and the induced current has no association relationship with the distance d between the first element and the second element. An adjustable capacitor is disposed at an end of the second element close to the reference plane, and a capacitance value of the adjustable capacitor changes, so that the phase difference between the excitation current and the induced current changes, thereby adjusting the direction of the beam radiated by the antenna.

For example, if the capacitance value C is equal to infinity so that $\zeta=-\pi/2$, the beam points to a direction of $\varphi=\pm 180°$ along an axis, as shown in FIG. 3C2. If the capacitance value C makes $\zeta=\pi$, the beam points to a direction of $\varphi=180°$ along an axis, as shown in FIG. 3B2. If the capacitance value C makes $\zeta=2\pi$, the beam points to a direction of $\varphi=0°$ along the axis, as shown in FIG. 3A2.

Moreover, in this embodiment, the antenna may alternatively include one active antenna, a plurality of passive antennas, and a reactance-adjustable component, and the reactance-adjustable component may be disposed at an end of the active element close to a reference plane; and/or the reactance-adjustable component is disposed at an end of at least one passive element close to a reference plane.

For example, the reactance-adjustable component may be disposed at an end of the active element close to the reference plane, or the reactance-adjustable component may be disposed at an end of at least one passive element close to the reference plane, or reactance-adjustable components are disposed both at an end of the active element close to the reference plane and at an end of at least one passive element close to the reference plane.

Herein, a quantity of passive antennas is not limited in this embodiment.

Further, the reactance value of the reactance-adjustable component is changed, so that a sum of phase differences between an excitation current received by the active element and induced currents generated by the plurality of passive elements changes, to implement that a target angle of radiation of the antenna points to a direction required by a user. In this way, a beam radiated by the antenna including one active element, a plurality of passive elements, and a reactance-adjustable component may point to any direction specified by the user, and arrangement of the plurality of passive antennas may effectively improve transmitting performance of the antenna and the terminal including the antenna.

A specific implementation principle of the antenna including one active element, a plurality of passive elements, and a reactance-adjustable component is the same as that of the antenna including one active element, one passive element, and a reactance-adjustable component in the embodiments in FIG. 2 to FIG. 4 in terms of a change of the reactance value of the reactance-adjustable component to make the target angle of radiation point to the direction required by the user. Details are not described in this embodiment.

Figure 5:
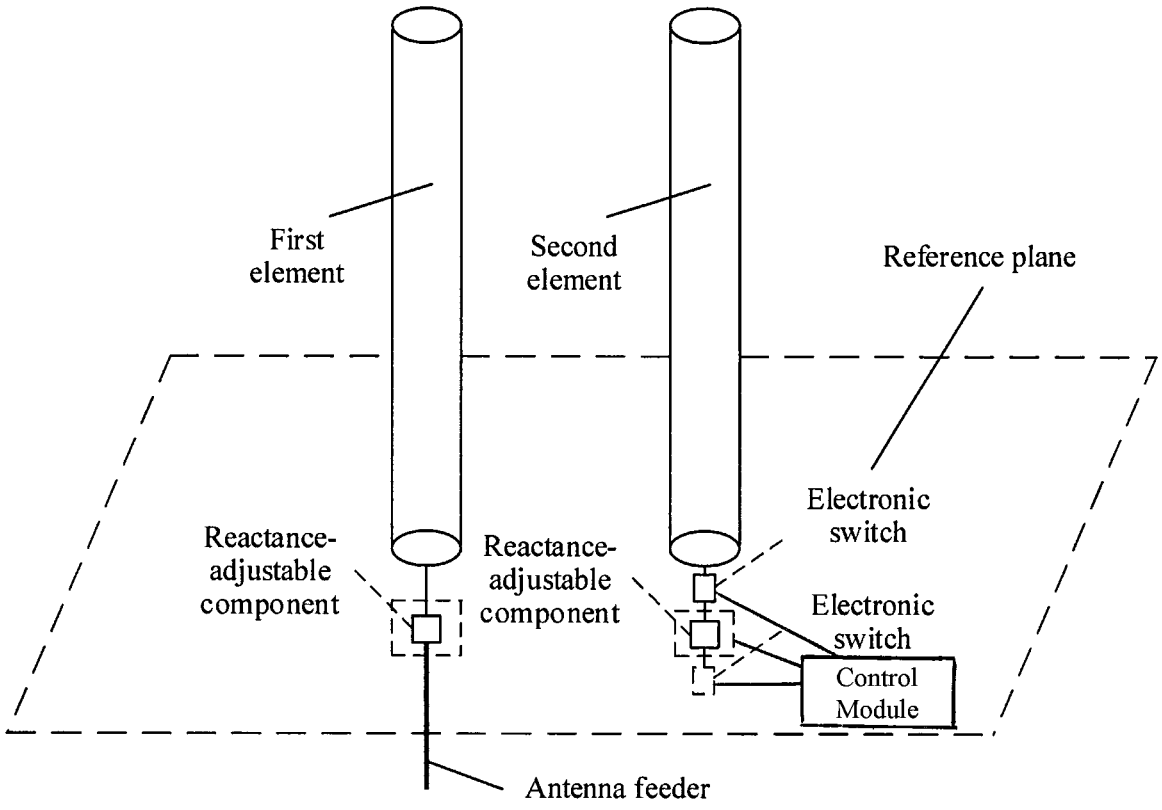
FIG. 5 is a schematic structural diagram of an antenna according to an embodiment.

For example, based on the embodiment shown in FIG. 5, an embodiment further provides an antenna. FIG. 5 is a schematic structural diagram of an antenna according to an embodiment. As shown in FIG. 5, a difference from FIG. 2 lies in that the antenna in this embodiment further includes a control module (not shown in FIG. 5) and an electronic switch.

The electronic switch is connected in series to the second element, and the control module is separately connected to an adjustment end (not shown in FIG. 5) of the reactance-adjustable component and a control end (not shown in FIG. 5) of the electronic switch.

The control module is configured to change the reactance value of the reactance-adjustable component and an on/off state of the electronic switch.

In this embodiment, because the reactance-adjustable component is disposed at an end of the second element close to the reference plane, and the electronic switch is connected in series to the second element, the electronic switch may be connected in series between the second element and the reactance-adjustable component, or the electronic switch may be sequentially connected to the reactance-adjustable component and the second element. This is not limited in this embodiment. In addition, the control module may adjust a magnitude of the reactance value of the reactance-adjustable component through a connection to the reactance-adjustable component. The control module may also control an on/off state of the electronic switch through a connection to the electronic switch.

When the antenna needs to implement omnidirectional radiation, the control module may turn off the electronic switch, so that the second element cannot meet a resonance condition, and the second element cannot generate an induced current. In this way, the antenna including only the first element can radiate omnidirectionally.

When the antenna needs to implement radiation at the target angle, the control module may adjust a magnitude of the reactance value of the reactance-adjustable component based on the direction specified by the user, and the control module turns on the electronic switch, so that the second element meets a resonance condition, and the second element generates the induced current. Because the phase difference between the excitation current and the induced current changes with the reactance value of the reactance-adjustable component, the antenna may radiate at the target angle, to implement directional radiation of the antenna.

The control module may be an integrated chip or an integrated circuit including a plurality of components. Models of the control module and the electronic switch are not limited in this embodiment.

According to the antenna provided in this embodiment, the electronic switch is connected in series to the second element, and the control module turns off the electronic switch so that the second element cannot generate an induced current, thereby implementing omnidirectional radiation of the antenna; and then the control module turns on the electronic switch and adjusts the reactance value of the reactance-adjustable component according to an actual requirement, thereby implementing radiation at the target angle of the antenna. Further, settings of the control module and the electronic switch can flexibly implement omnidirectional radiation and directional radiation of the antenna, to meet various actual requirements.

Figure 6:
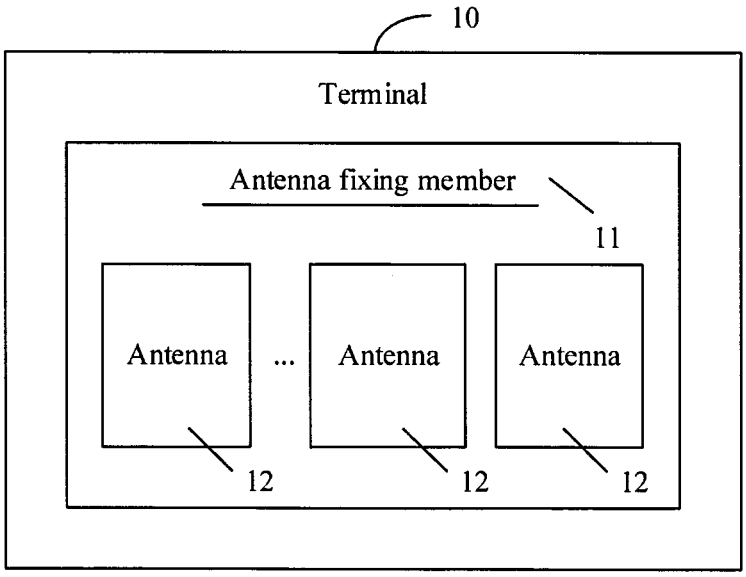
FIG. 6 is a schematic structural diagram of a terminal according to an embodiment.

For example, based on the embodiments shown in FIG. 1 to FIG. 5, an embodiment further provides a terminal. FIG. 6 is a schematic structural diagram of a terminal according to an embodiment. As shown in FIG. 6, the terminal 10 in this embodiment may include an antenna fixing member 11 and at least one antenna 12. The antenna 12 is disposed on the antenna fixing member 11.

For a structure of the antenna 12, refer to descriptions in the embodiments shown in FIG. 1 to FIG. 5. Details are not described herein again.

The terminal provided in this embodiment may be a communications terminal such as an AP, an ONT, or a router.

The foregoing implementations, schematic structural diagrams, or schematic simulation diagrams are merely examples for describing the solutions of the embodiments. Size proportions and simulation values do not constitute any limitation on the scope of the solutions. Any modification, equivalent replacement, or improvement made within the spirit and principle of the foregoing implementations shall fall within the scope of the solutions.

What is claimed is:

1. An antenna, comprising:

a first element, wherein the first element is configured to receive an excitation current through an electrical connection to an antenna feeder and changes in the excitation current change a magnetic field around the first element, a second element, wherein the second element is configured to generate an induced current through electromagnetic induction of the first element based on the change in the magnetic field around the first element; and a reactance-adjustable component, wherein the reactance-adjustable component is disposed both at an end of the first element close to a reference plane, and at an end of the second element close to the reference plane, the reference plane uses a connection point between the first element and the antenna feeder as an origin and is perpendicular to an axial direction of the first element, the reactance-adjustable component has an adjustable reactance value and is configured to adjust a phase difference between the excitation current and the induced current, and the phase difference has an association relationship with a target angle of radiation of the antenna.

2. The antenna according to claim 1, wherein the association relationship between the phase difference and the target angle is determined according to the following formula:

$$F(\varphi)=f_{element}(\varphi)*f_{array}(\varphi)$$

wherein $F(\varphi)$ is a direction pattern function of an array formed by the first element and the second element, $f_{element}(\varphi)$ is an element factor function, $f_{array}(\varphi)$ is an array factor function, $f_{array}(\varphi)=\cos((kd\cos\varphi+\zeta/2)$, $k=2\pi/\lambda$ is a wave vector of an electromagnetic wave, d is a distance between the first element and the second element, $\varphi$ is the target angle, and $\zeta$ is the phase difference between the excitation current and the induced current.

3. The antenna according to claim 1, wherein the reactance value of the reactance-adjustable component has an association relationship with the phase difference, the association relationship between the reactance value of the reactance-adjustable component and the phase difference is represented by a complex matrix S, and the complex matrix S is determined by using the following formula:

$$[S]=\frac{1}{2+jX/R_0}\begin{bmatrix}\frac{jX}{R_0} & 2\\ 2 & \frac{jX}{R_0}\end{bmatrix}$$

wherein $jX=j(X_L-X_C)$ is the reactance value of the reactance-adjustable component, $$-X_C=-\frac{1}{\omega C}$$

is a capacitive reactance value of the reactance-adjustable component, $X_L=\omega L$ is an inductance value of the reactance-adjustable component, L is an inductance value of the reactance-adjustable component, C is a capacitance value of the reactance-adjustable component, w is an angular frequency, and $R_0$ is a characteristic impedance.

4. The antenna according to claim 1, wherein the phase difference further has an association relationship with a length of the antenna and the distance between the first element and the second element.

5. The antenna according to claim 4, wherein the distance between the first element and the second element is d, $0.15\lambda\leq d\leq 0.5\lambda$, and $\lambda$ is a free space wavelength.

6. The antenna according to claim 1, wherein both the first element and the second element are monopole antennas; and the reactance-adjustable component is connected in series between the first element and the antenna feeder; and/or the reactance-adjustable component is connected in series between the second element and a ground plate.

7. The antenna according to claim 1, wherein the first element is a dipole antenna, and the second element is a monopole antenna; and the reactance-adjustable component is connected in series to at least one arm of the first element; and/or the reactance-adjustable component is connected in series between the second element and a ground plate.

8. The antenna according to claim 6, wherein the phase difference further has an association relationship with a distance between the antenna and the ground plate and a size of the ground plate.

9. The antenna according to claim 1, wherein both the first element and the second element are dipole antennas; and the reactance-adjustable component is connected in series to at least one arm of the first element; and/or the reactance-adjustable component is connected in series between two arms of the second element.

10. The antenna according to claim 1, wherein the first element is a monopole antenna, and the second element is a dipole antenna; and the reactance-adjustable component is connected in series between the first element and the antenna feeder; and/or the reactance-adjustable component is connected in series between two arms of the second element.

11. The antenna according to claim 1, further comprising a control module and an electronic switch, wherein the electronic switch is connected in series to the second element, and the control module is separately connected to an adjustment end of the reactance-adjustable component and a control end of the electronic switch; and the control module is configured to change the reactance value of the reactance-adjustable component and an on-off state of the electronic switch.

12. The antenna according to claim 1, wherein the reactance-adjustable component comprises a capacitor and/or an inductor.

13. A terminal, comprising: an antenna fixing member and at least one antenna disposed on the antenna fixing member, and the antenna comprises:

a first element, wherein the first element is configured to receive an excitation current through an electrical connection to an antenna feeder and changes in the excitation current change a magnetic field around the first element;

a second element, wherein the second element is configured to generate an induced current through electromagnetic induction of the first element based on the change in the magnetic field around the first element; and a reactance-adjustable component, wherein the reactance-adjustable component is disposed both at an end of the first element close to a reference plane and at an end of the second element close to the reference plane, the reference plane uses a connection point between the first element and the antenna feeder as an origin and is perpendicular to an axial direction of the first element, the reactance-adjustable component has an adjustable reactance value and is configured to adjust a phase difference between the excitation current and the induced current, and the phase difference has an association relationship with a target angle of radiation of the antenna.

14. The terminal according to claim 13, wherein the association relationship between the phase difference and the target angle is determined according to the following formula:

$$F(\varphi)=f_{element}(\varphi)*f_{array}(\varphi)$$

wherein $F(\varphi)$ is a direction pattern function of an array formed by the first element and the second element, $f_{element}(\varphi)$ is an element factor function, $F_{array}(\varphi)$ is an array factor function, $f_{array}(\varphi)=\cos((kd \cos \varphi+\zeta/2)$, $k=2\pi/\lambda$ is a wave vector of an electromagnetic wave, d is a distance between the first element and the second element, $\varphi$ is the target angle, and $\zeta$ is the phase difference between the excitation current and the induced current.

15. The terminal according to claim 13, wherein the reactance value of the reactance-adjustable component has an association relationship with the phase difference, the association relationship between the reactance value of the reactance-adjustable component and the phase difference is represented by a complex matrix S, and the complex matrix S is determined by using the following formula:

$$[S] = \frac{1}{2 + jX/R_0}\begin{bmatrix} \frac{jX}{R_0} & 2 \\ 2 & \frac{jX}{R_0} \end{bmatrix}$$

wherein $jX=j(X_L-X_C)$ is the reactance value of the reactance-adjustable component, $$-X_C = -\frac{1}{\omega C}$$

is a capacitive reactance value of the reactance-adjustable component, $X_L=\omega L$ is an inductance value of the reactance-adjustable component, L is an inductance value of the reactance-adjustable component, C is a capacitance value of the reactance-adjustable component, $\omega$ is an angular frequency, and $R_0$ is a characteristic impedance.

16. The terminal according to claim 13, wherein the phase difference further has an association relationship with a length of the antenna and the distance between the first element and the second element.

17. The terminal according to claim 16, wherein the distance between the first element and the second element is d, $0.15\lambda \le d \le 0.5\lambda$, and $\lambda$ is a free space wavelength.

18. The terminal according to claim 13, wherein both the first element and the second element are monopole antennas; and the reactance-adjustable component is connected in series between the first element and the antenna feeder; and/or the reactance-adjustable component is connected in series between the second element and a ground plate.

19. The terminal according to claim 13, wherein the first element is a dipole antenna, and the second element is a monopole antenna; and the reactance-adjustable component is connected in series to at least one arm of the first element; and/or the reactance-adjustable component is connected in series between the second element and a ground plate.

20. The terminal according to claim 18, wherein the phase difference further has an association relationship with a distance between the antenna and the ground plate and a size of the ground plate.

* * * * *